US007431163B2

(12) United States Patent
Andersen

(10) Patent No.: US 7,431,163 B2
(45) Date of Patent: Oct. 7, 2008

(54) COMBINATION SHIPPING/DISPLAY CONTAINER

(75) Inventor: John L. Andersen, Flint, TX (US)

(73) Assignee: Builder's Best, Inc., Jacksonville, TX (US)

( * ) Notice: Subject to any disclaimer, the term of this patent is extended or adjusted under 35 U.S.C. 154(b) by 606 days.

(21) Appl. No.: 10/709,855

(22) Filed: Jun. 2, 2004

(65) Prior Publication Data

US 2005/0269243 A1 Dec. 8, 2005

(51) Int. Cl.
*B65D 5/50* (2006.01)

(52) U.S. Cl. ..... 206/736; 206/751; 206/45.29

(58) Field of Classification Search ..... 206/736, 206/746, 747, 751, 766, 526, 45.29; 229/122, 229/125

See application file for complete search history.

(56) References Cited

U.S. PATENT DOCUMENTS

| | | | | |
|---|---|---|---|---|
| 3,604,560 | A * | 9/1971 | Farquhar | 206/784 |
| 5,622,309 | A * | 4/1997 | Matsuda et al. | 229/243 |
| 5,657,872 | A * | 8/1997 | Leftwich et al. | 206/738 |
| 6,105,854 | A * | 8/2000 | Spivey et al. | 229/122.1 |
| 6,932,265 | B2 * | 8/2005 | Sax et al. | 229/122 |
| 6,938,818 | B2 * | 9/2005 | Moorman et al. | 229/122 |

* cited by examiner

*Primary Examiner*—David T. Fidei
(74) *Attorney, Agent, or Firm*—McGarry Bair PC

(57) ABSTRACT

A container comprises first and second ends, the first end being closable in conventional manner by flaps, and the second end having a display panel that partially defines a display opening. A closure panel is movable between a closed position where it covers the display opening for shipping the container, and an open position where the display opening and display panel are exposed to display contents of the container. The display panel includes side panels and a securing panel interlocked with the side panels.

31 Claims, 15 Drawing Sheets

COMBINATION SHIPPING/DISPLAY CONTAINER

FIELD OF THE INVENTION

The invention relates to a container that can be used to ship a product and also to conveniently display the product at a retail location.

DESCRIPTION OF THE RELATED ART

A problem facing retail merchandisers is the cost of "the final 50 feet" of the distribution channel. It is common to ship products through the distribution chain in a conventional corrugated box such as a regular slotted carton (commonly called an "RSC") or a full flap slotted carton (sometimes referred to as FOL for "full overlap"). These traditional cartons are the most cost-effective for regular shipment. But a retail merchandiser has to either remove the product from the carton for display or convert the shipping carton for display. The former is labor-intensive and very costly. For many mass merchandisers, the latter is often accomplished by Cut Case Displays, created by cutting the carton with the product in it, so a consumer can readily see the product in the carton. Cutting the carton in situ risks damaging the product and leaves unsightly corrugated edges. Notwithstanding the unsightly edges, carton manufacturers are known to mark RSC or FOL boxes to show a retailer where to cut for an adequate display of the contents. A known alternative is to perforate the carton along predetermined lines so that a portion of the carton can be removed by the retailer along the perforations without having to cut the carton. The result, however, leaves unsightly perforated edges.

Another common alternative to a Cut Case Display is a Tray Pack, which typically comprises a half slotted carton (commonly called an "HSC") that is open at the top so that the product can be readily viewed. Frequently the carton is die cut to provide an opening on one side of the box to allow additional viewing area for the product to be seen through what would otherwise be the side of the box. To ship the Tray Pack, a lid covers the top and sides for protection of the product and to strengthen the carton. Usually the lid is a second HSC not die cut, although it can also be an RSC or FOL, as needs warrant. The advantage to a Tray Pack is better display appearance with clean-cut edges, consistent cuts, and no chance of damage to the product due to in situ cutting. But unsightly corrugated edges may yet remain and a major disadvantage to the Tray Pack is cost. Two boxes (display carton and lid) cost more than one in manufacture, inventory, assembly, and materials.

There remains a need for a less costly, more convenient carton for shipping product and then neatly displaying the product for purchase. This is especially important for bulk retailers, discount retailers, and home improvement outlets.

SUMMARY OF THE INVENTION

According to the invention, a container for shipping and displaying contents in the container includes a first end having at least one panel selectively movable to close it, and a second end. The second end has a display panel that partially defines an opening, and a closure panel selectively movable between a closed position where it covers the opening, and an open position where the opening is exposed. Thus, contents of the container can be shipped when the first end is closed and the closure panel is in the closed position. Conversely, contents of the container can be displayed by moving only the closure panel to the open position.

Preferably, the container has top, bottom and side panels extending between the first and second ends. The display panel extends from one of the top, bottom and side panels, and the closure panel extends from another of the top, bottom and side panels. The closure panel is secured to one of the top, bottom and side panels in the open position. The closure panel can have a tab, and the one panel can have a slot so that the closure panel can be secured to the one panel when the tab is received in the slot. Also, it is preferable that the closure panel covers the display panel and the opening in the closed position, and the display panel and the opening are exposed when the closure panel is in the open position.

Preferably, the display panel comprises two side panels and a securing panel wherein the securing panel interlocks with the side panels. The side panels are spaced from the top panel, and the closure panel is secured to the top panel in the open position. Preferably, the securing panel has a cover portion and a flap portion, and the flap portion engages a slot in the bottom panel. The flap portion can also have a tab that engages the slot. Likewise, one or both side panels can have a tab that engages the slot.

In one aspect, the closure panel has a tab and the top panel has a slot and the closure panel can be secured to the top panel in the open position when the tab is received in the slot. The first end can be full overlap panels, or not. Also, the side panels can have sloped edges, and the side panels can be covered by the securing panel.

In another aspect of the invention, a blank for forming a container for shipping and displaying contents in the container includes four panels hinged together in series. A panel at one side of the series has a side flap for mounting to a panel at the opposite side of the series. The panels have first ends and second ends, the first ends of the four panels collectively defining a first end of the erected container, and the second ends of the four panels collectively defining a second end of the erected container. The first end of each panel has an end panel extending therefrom. The second end of one of the four panels has a closure panel extending therefrom. The second end of the four panels, other than the one having a closure panel extending therefrom, has a display panel extending therefrom.

Preferably, the display panel has two of the four panels, one on either side of the panel that the closure panel extends from, having a side panel extending from an edge. Preferably, the side panels are located away from where the closure panel extends from the top panel when the container is erected.

The second end of the fourth panel has a securing panel extending from it with a slot near where the hinge point. The securing panel has a cover portion and a flap extending from the cover portion. The flap is adapted to engage the slot and is long enough to reach the slot when it is folded against the cover portion over the side flaps.

Preferably, the flap has a tab adapted to reach and engage the slot. Also, preferably, the edges of the two panels are offset so that the closure panel can be flush with the second end when it is in the closed position. A tab can be provided on the closure panel and a securing slot on the top panel to secure the closure panel to the top panel. In another aspect of the invention, at least one of the side panels has a tab to engage the slot. And in yet another aspect, a flat preform can be formed from a blank by folding along designated fold lines and securing the flap to its adjacent panel when folded.

DETAILED DESCRIPTION

The invention is illustrated here in several embodiments of cartons, preferably formed of corrugated paperboard. In its most rudimentary aspects, however, the invention relates to containers, whether cartons or not. And containers according to the invention can be formed of any suitable material such as plastic, cardboard, foam, or corrugated paperboard has illustrated here.

Figure 1:
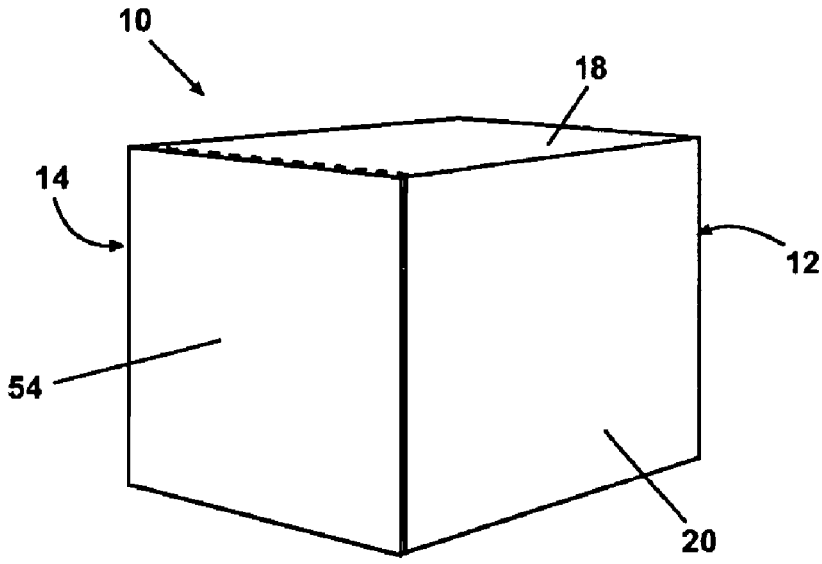
FIG. 1 is a front perspective view of a container according to the invention with a closure panel in a closed position.
Figure 2:
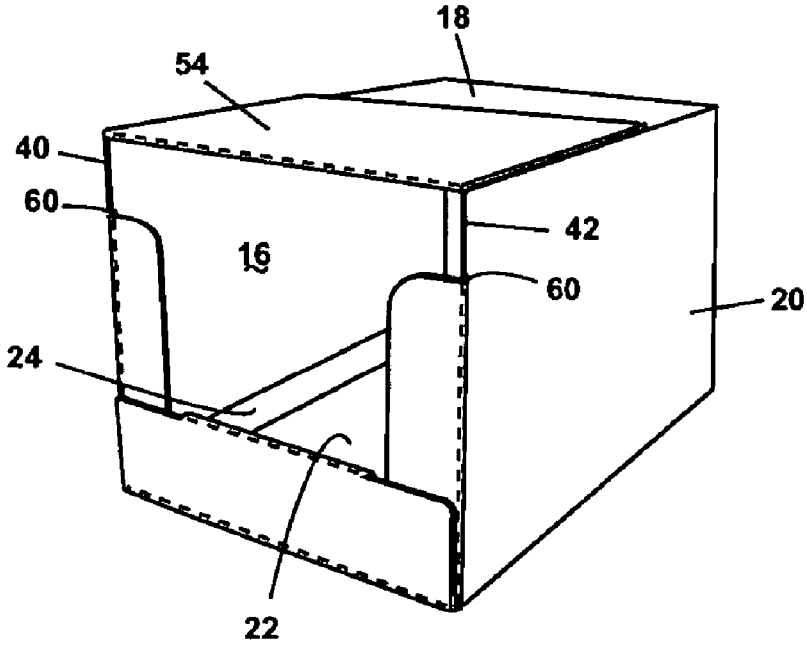
FIG. 2 is a front perspective view of the container of FIG. 1 with the closure panel in an open position.

Looking now FIGS. 1-8, a first embodiment of a container according to the invention is shown in carton 10. The carton 10 comprises a first end 12 and an oppositely disposed second end 14. The first and second ends 12, 14 are separated by four panels 16, 18, 20, and 22, hinged together in series. In the erected carton 10 as shown in FIGS. 1 and 2, the panels 16 and 20 are side panels, the panel 18 is a top panel, and the panel 22 is a bottom panel. A side flap or glue flap 24 extends from the bottom panel 22 and is preferably glued to the side panel 16 in the erected carton 10. It can also be stitched or stapled or affixed in any manner to effect securing the bottom panel 22 to the side panel 16. In that respect, the side flap 24 itself can be tape by which the bottom panel 22 is secured to the side panel 16.

Figure 3:
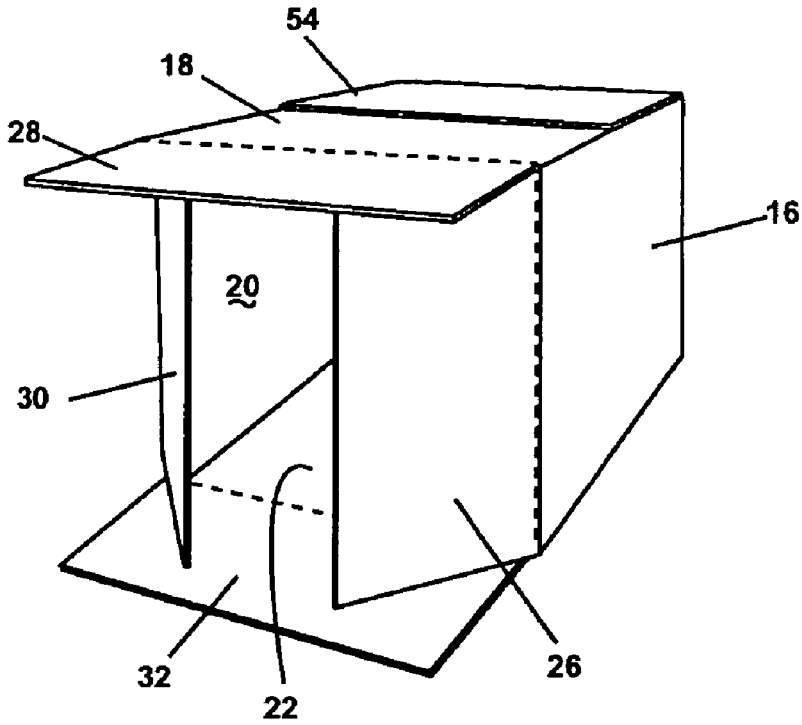
FIG. 3 is a rear perspective view of the container of FIG. 1 partially open.

The first end 12 is better illustrated in FIG. 3 where four half panels 26, 28, 30, and 32 extend respectively from the four panels 16, 18, 20, and 22. In this embodiment the four half panels 26, 28, 30, and 32 effectively function to close the first end 12 in the same manner that a conventional RSC or HSC is closed. It will be understood that the number and shape of panels on the first end 12 is not important to the invention so long as there is at least one to close the first end. In this respect, a single panel sufficient to close the first end 12 would be adequate.

Figure 4:
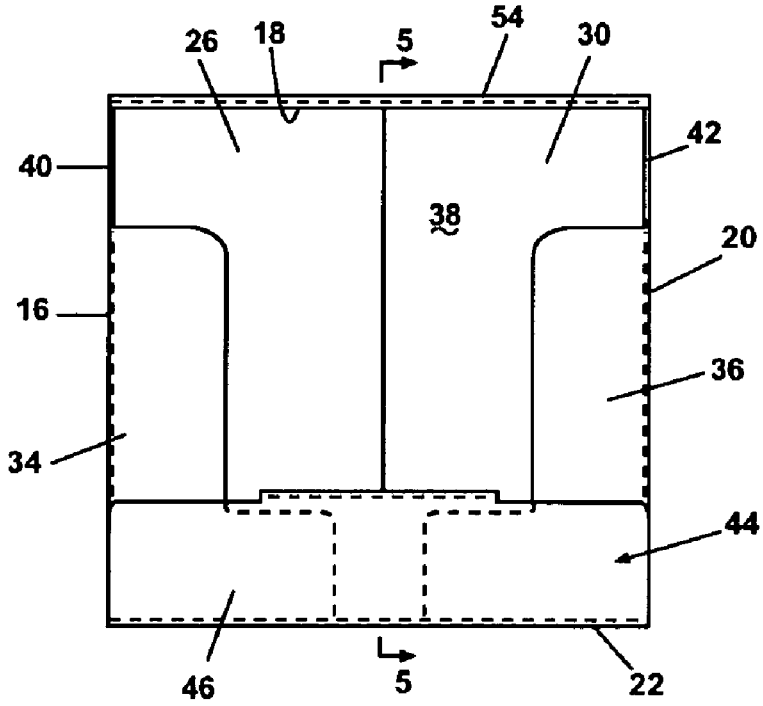
FIG. 4 is a front view of the container of FIG. 2.
Figure 8:
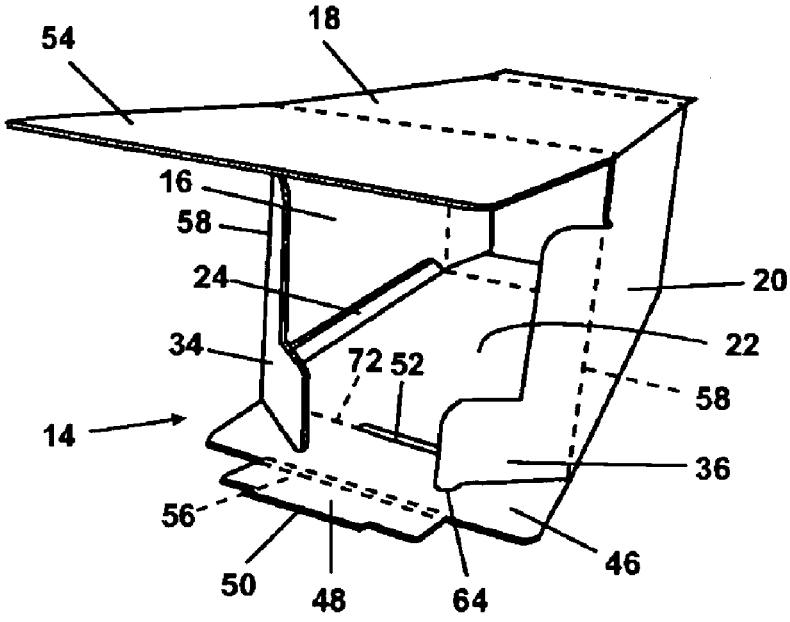
FIG. 8 is a perspective view of the blank of FIG. 6 partly erected.
Figure 9:
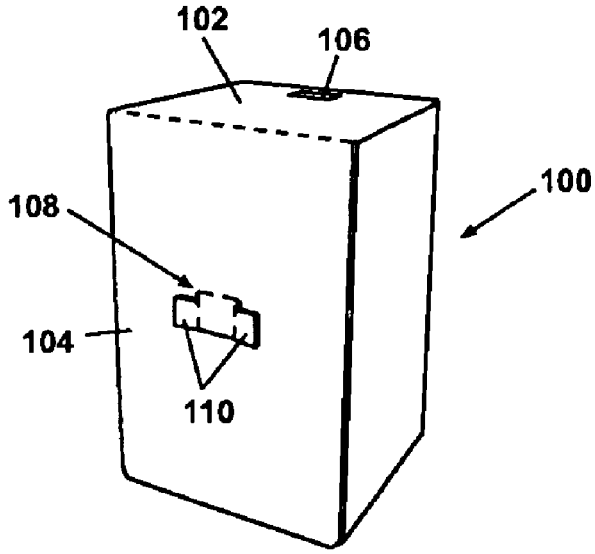
FIG. 9 is a front perspective view of a second embodiment of a container according to the invention with a closure panel in the closed position.

A second end 14 is best illustrated in FIGS. 2, 4, and 8 and is adapted to enable display of the contents of the carton 10. A pair of L-shaped side panels 34, 36 extend, respectively, from edges 40, 42 of the carton side panels 16, 20. The L-shaped side panels 34, 36 are folded so that the longer arm of the "L" shape partially defines an opening 38 in the second end 14. The side panels 34, 36 are preferably spaced from the top panel 18 so that a portion of each edge 40, 42 is exposed, and also partially defines the opening 38. The amount of exposure, if any, of each edge 40, 42 is entirely optional.

The shorter arms of the L shaped side panels 34, 36 meet or nearly meet each other, but are obscured in the views of FIGS. 2 and 4 by a securing panel 44 that extends from the bottom panel 22 and is folded over the shorter arms of the L-shaped side panels 34, 36, and partially defines the opening 38. The securing panel 44 has a cover portion 46 and a flap portion 48 extending from the cover portion 46 that is folded over the shorter arms of the L-shaped side panels 34, 36. The flap portion 48 has a tab 50 that is secured in a slot 52. In this manner, the securing panel 44 is interlocked with the side panels 34, 36. The side panels 34, 36 and the securing panel 44 together form a display panel 53 that partially defines the opening 38. The display panel 53 not only frames the opening and thus showcases the contents of the carton 10, but it also provides strength and rigidity to the second end 14.

A closure panel 54 extends from the top panel 18 and is hinged thereto where it can be moved between a closed position covering the opening 38 (see FIG. 1) and an open position where the opening 38 is exposed (see FIG. 2). In the closed position, the closure panel 54 can be secured by any conventional means such as glue or tape to enable the container 10 and its contents to be shipped. In the open position, the closure panel 54 can be folded back over the top panel 18 as illustrated in FIGS. 2 and 4, and secured thereto by any conventional means to enable the contents of the container 10 to be displayed through the opening 38.

Figure 5:
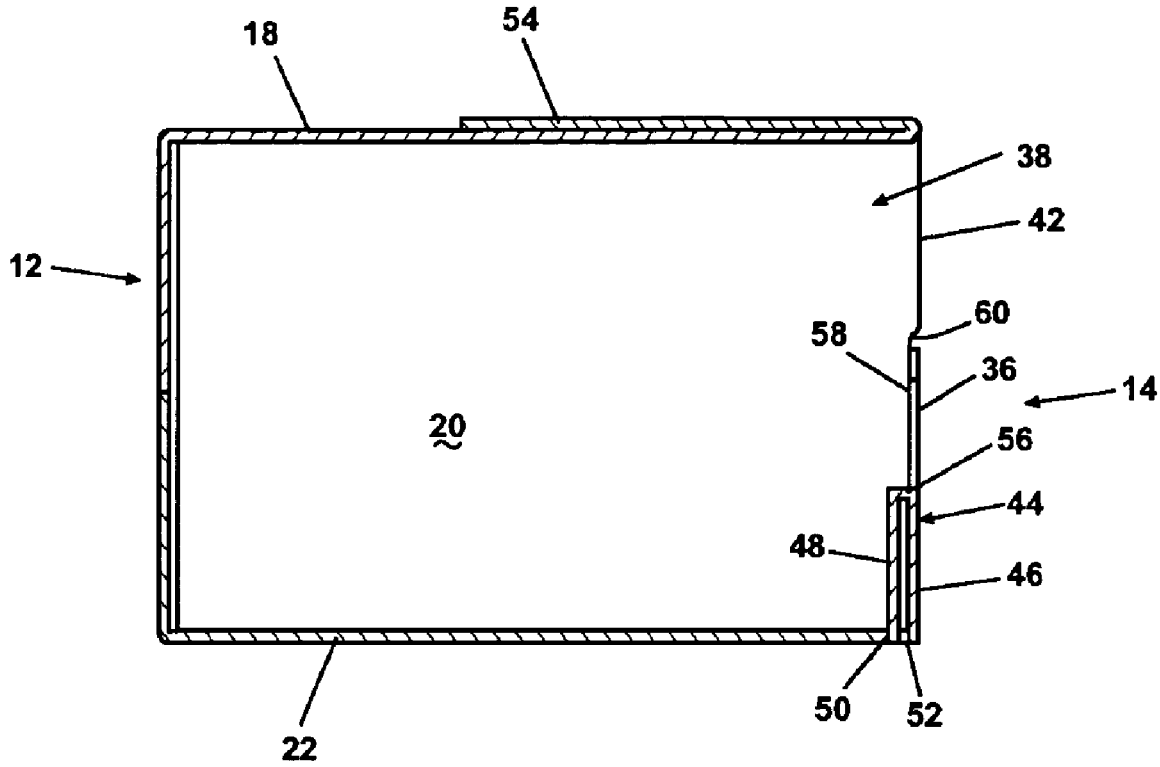
FIG. 5 is a cross-sectional view taken along line 5-5 of FIG. 4.

Looking now at FIG. 5, more detail concerning the second end 14 can be seen. Because the flap portion 48 of the securing panel 44 must be folded over the side panels 34, 36, and because the panels in this embodiment have a thickness due to their construction from corrugated paperboard, a double hinge 56 is provided at the connection between the flap portion 48 and cover portion 46. Also, in order to provide a flat face on the second end 14 so that the closure panel 54 can rest flush against the face during shipping, the fold line or hinge 58 for the side panels 34, 36 (seen only with respect to side panels 36 in FIG. 5) is offset inwardly from the edges 38, 40. Where the side panels 34, 36 are spaced from the top panel 18, the offset is accommodated by a notch 60 between the side panels 34, 36 and the respective edges 38, 40.

Figure 6:
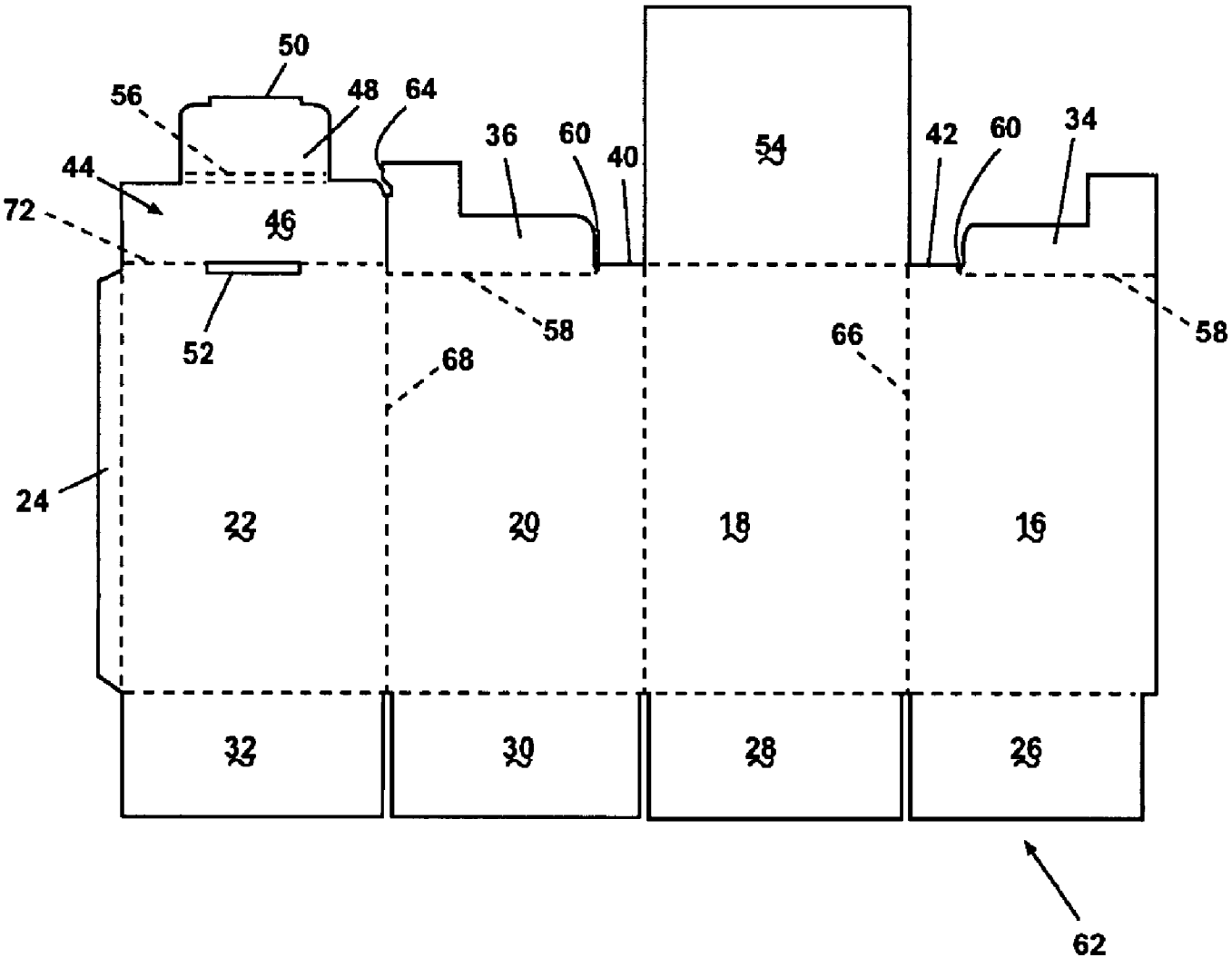
FIG. 6 is a plan view of a blank for the container of FIG. 1.
Figure 7:
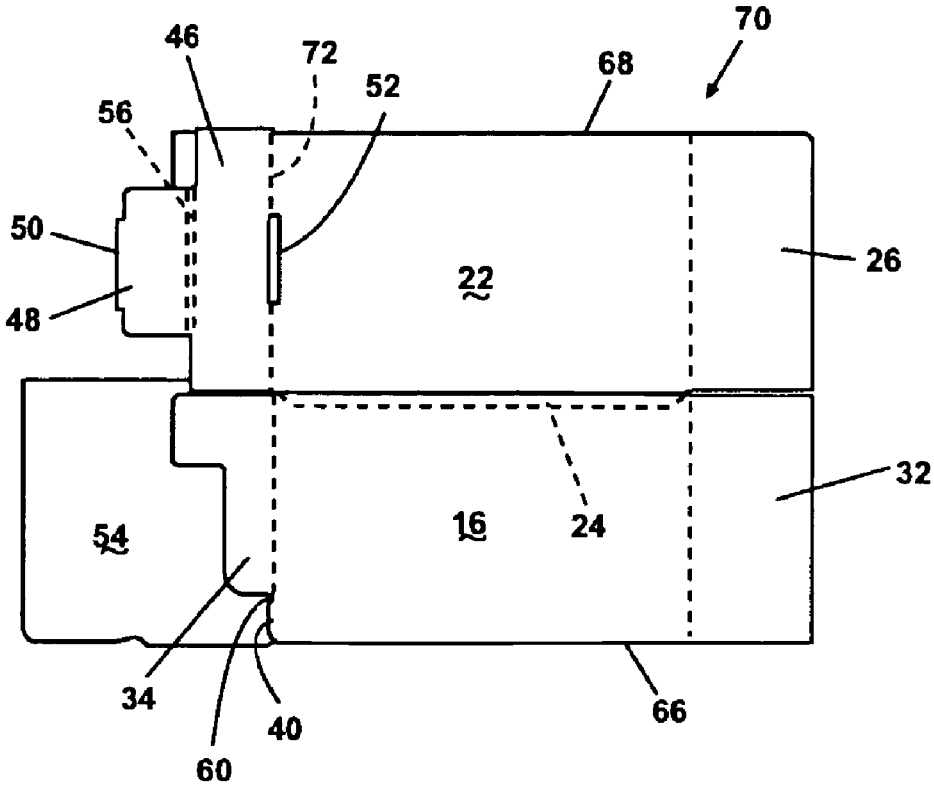
FIG. 7 is a plan view of the blank of FIG. 6 partly assembled for storage.

Referring now also to FIG. 6 where a blank 62 for forming a carton 10 is shown, a tab 64 can be provided on one or both of the side panels 34, 36 to engage the slot 52 and assist in securing the side panel or panels 34, 36 at the second end 14. It will be apparent that the blank 62 can be formed in conventional manner, preferably die cut, and that when the blank 62 is folded along a fold line 66 between the side panel 16 and the top panel 18, and also along the fold line 68 between the side panel 20 and the bottom panel 22, and the glue flap 24 is secured to the side panel 16 by conventional means, a flat preform 70 as illustrated in FIG. 7 is provided for stacking and convenient storing.

Erection of the carton 10 is best illustrated in FIGS. 3 and 8. When the fold lines 66 and 68 are pressed toward each other, the preform 70 opens to form the generally rectilinear construction shown in FIG. 8. At the second end 14, the side panels 34, 36 are folded along the fold lines 58. If available, the tab 64 on the side panel 34 (and also possibly on the side panel 36) is inserted into the slot 52. The securing panel 44 is folded upwardly along its fold line 72, and the flap portion thereof 48 is folded over the side panels 34, 36 along the double hinge 56. The tab 50 is inserted into the slot 52 so that the securing panel 44 is interlocked with the side panels 34, 36. Inasmuch as the carton 10 will likely be used first for shipping product, the closure panel 54 is folded to the closed position and secured either to the securing panel 44 or to the bottom panel 22 in a well-known manner.

At this point, the first end 12 remains open, and product can be placed in the carton 10 through the open first end. Preferably, product will be disposed in the carton 10 in a manner that will best position it for display when the closure panel 54 is later moved to the open position. Once the carton 10 is filled, the first end 12 is closed in conventional manner by folding and securing the four half panels 26, 28, 30, and 32. The carton 10 and its contents are now ready for shipment. When the carton 10 is received by the retailer, it can be simply disposed in a location where the second end 14 is visible to potential purchasers of the contents thereof. The closure panel 54 is released from its securement for shipping, and moved to the open position where it can be secured, for example, to the top panel 18. In this manner the contents of the carton 10 are now visible to potential purchasers through the opening 38.

It will be apparent that a portion of the display panel 53, i.e., a visible portion of the side panels 34, 36 and the cover portion 46 of the securing panel 44, is also visible when the closure panel 54 is in the open position. The display panel 53, then, is ideally positioned to display printed information, such as marketing or advertising information, or information about the contents, or the like when the closure panel 54 is in the open position.

A second embodiment of a container according to the invention is shown in the carton 100 of FIGS. 9-15. It will be apparent that the carton 100 has an overall construction very similar to the carton 10. Where components of carton 10 appear also in carton 100 but differ only in dimension, they will be identified by like numerals in both embodiments.

One of the differences in the second embodiment carton 100 is found in the top panel 102 and the closure panel 104. The top panel 102 includes a slot 106, and the closure panel 104 includes a tab 108. The tab 108 extends from a central portion of the closure panel 104, and it can be hingedly connected thereto. Pair of wings 110 extends on opposite sides of the tab 108, and preferably has a span greater than the length of the slot 106. When the closure panel 104 is in the open position, the wings 110 can be received in the slot 106. Because the span of the wings 110 is greater than the length of the slot 106, they will bear against an inner surface of the top panel 102 and retain the closure panel 104 in the open position (see FIG. 12).

Figure 11:
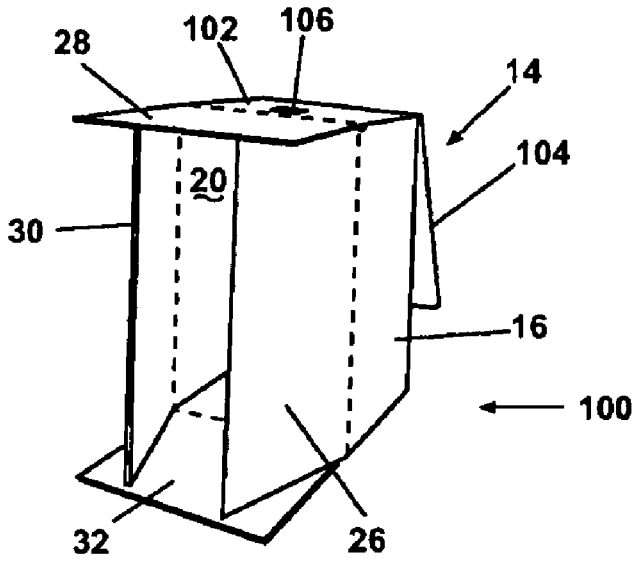
FIG. 11 is a rear perspective view of the container of FIG. 9 partially open.

Another difference in the second embodiment carton 100 can be seen in FIG. 11 where the panels 26, 28, 30, and 32 are full overlap (FOL) panels.

Figure 10:
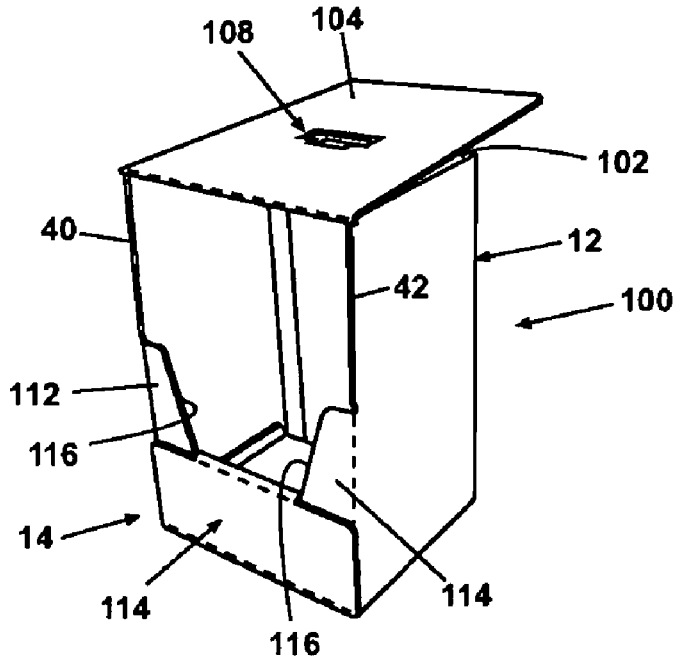
FIG. 10 is a front perspective view of the container of FIG. 9 with the closure panel in an open position.
Figure 12:
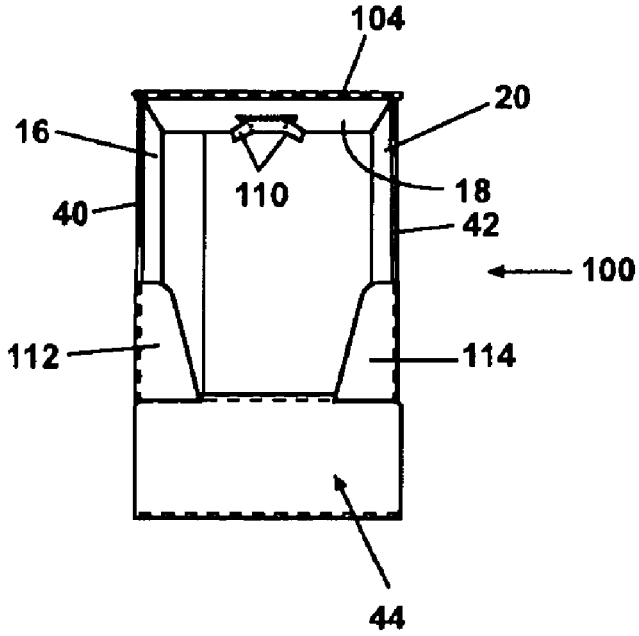
FIG. 12 is a front view of the container of FIG. 10.
Figure 13:
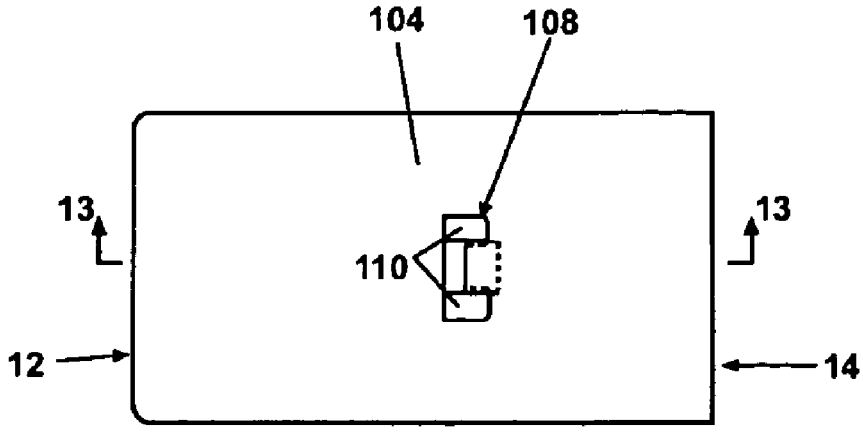
FIG. 13 is a top view of the container of FIG. 10.
Figure 14:
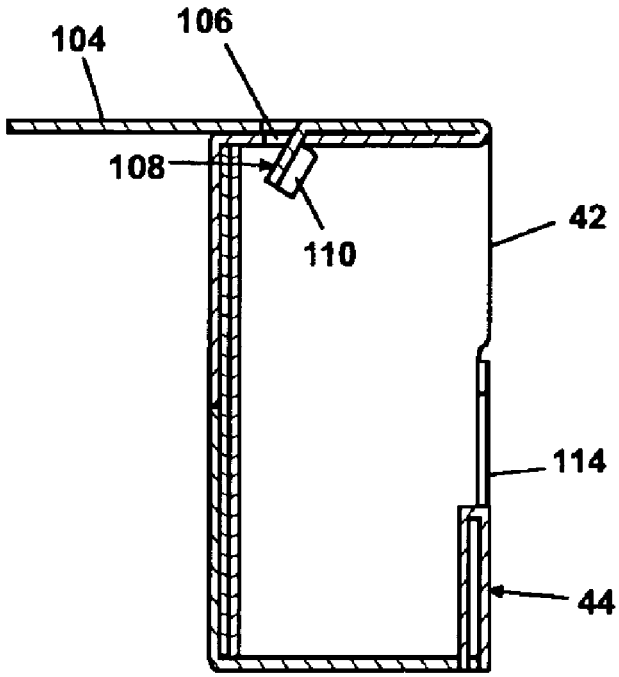
FIG. 14 is a cross-sectional view taken along line 14-14 of FIG. 13.
Figure 15:
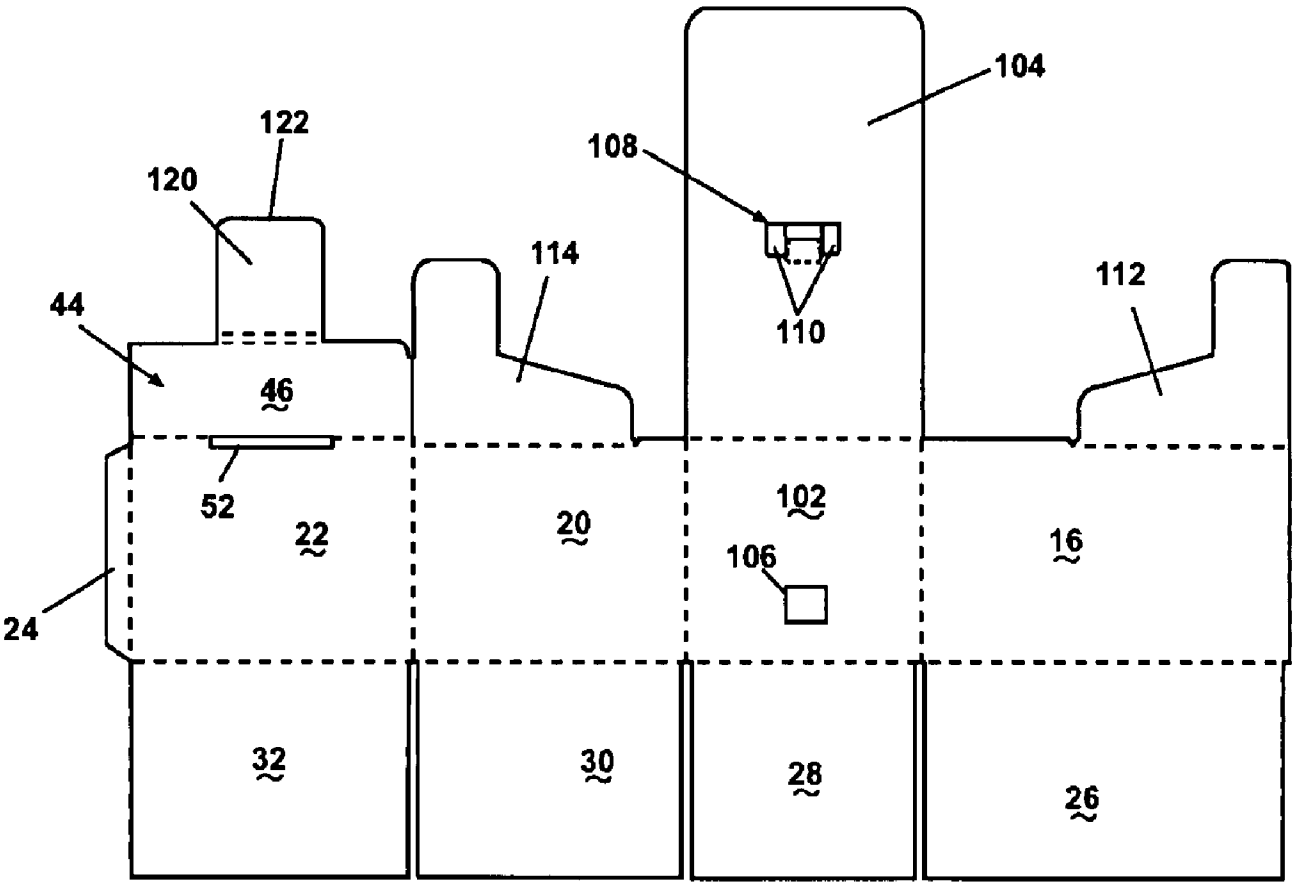
FIG. 15 is a plan view of a blank for the container of FIG. 9.

A further difference in the second embodiment carton 100 can be seen in FIGS. 10, 12, and 15 where the shape of each of the side panels 112, 114 is different. It will be apparent that an exposed edge 116 of each side panel 112, 114 is sloped to provide a different shape to the opening 118 through which contents of the carton 100 can be displayed. Still, the securing panel and the side panels 112, 114 together define a display panel 119 that provides rigidity to the second end, partially defines the opening, and provides a place to display visible information.

A further difference in the second embodiment carton 100 and be seen in FIG. 15 where a flap portion 120 of the securing panel 44 is sized so that the outward edge 122 thereof will reach and be snugly received in the slot 52 when the securing panel 44 interlocks with the side panels 112, 114.

Figure 16:
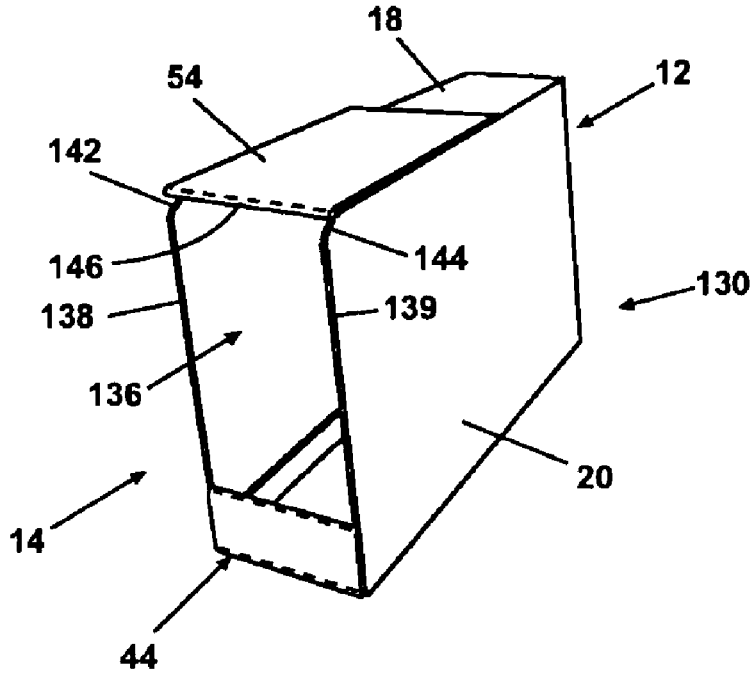
FIG. 16 is a front perspective view of a third embodiment of a container according to the invention with a closure panel in an open position.
Figure 17:
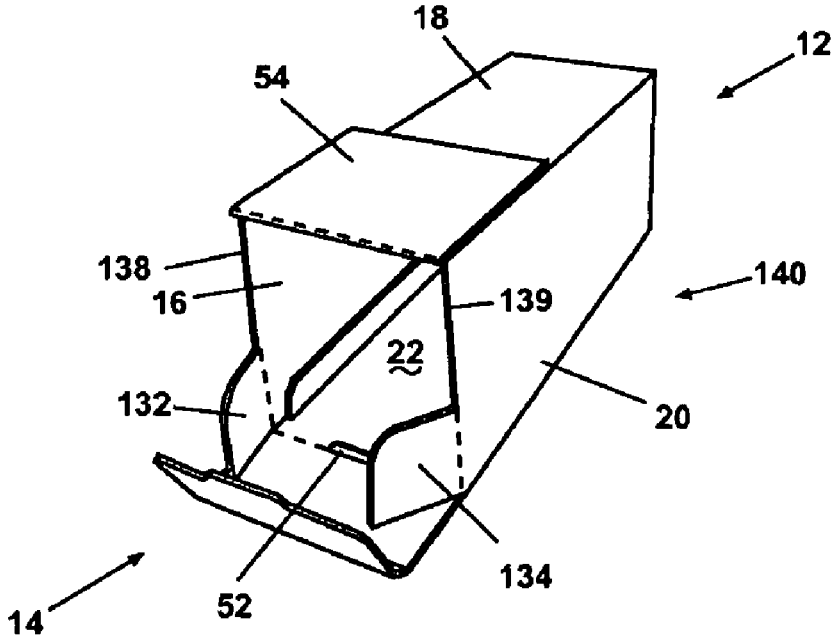
FIG. 17 is a front perspective view of a fourth embodiment of a container according to the invention, partly erected.

Third and fourth embodiments of containers according to the invention are shown in the cartons 130, 140 of FIGS. 16 and 17, respectively. As with the second embodiment carton 100, the overall construction of the cartons 130, 140 is very similar to the cartons 10, 100. Where components of cartons 10, 100 appear also in the cartons 130, 140 but differ only in dimension, they will be identified by like numerals in all embodiments. The only difference between the cartons 130, 140, other than dimension, relates to a minor feature of the closure panels. It will be understood that the first ends 12, 14 of the cartons 130, 140 can be like that of the first embodiment carton 10 or like that of the second embodiment carton 100.

Both cartons 130, 140 have side panels 132, 134 that are spaced far enough from the top panel 18 so as to be completely covered by the securing panel 44 when the cartons are erected. See, for example, the erected carton 130 in FIG. 16. Thus, the display opening 136 will be defined by the securing panel 44, the edges 138, 139, and the top panel 18. Also, the securing panel 44 and the side panels 132, 134 define a display panel 141, although in this embodiment only the securing panel 44 is visible. Its interlock with the side panels 132, 134 provide needed structural support and rigidity to the cartons 130, 140.

In all embodiments according to the invention, it is important that the closure panel 54 (102 in the second embodiment) be wide enough to cover the edges 38, 40 or 138, 139. In this respect, notches 142, 144 (see FIG. 16) can be provided to insure an unobstructed fold line 146 that will enable the closure panel 54 to completely cover the second end 14. Additionally, or alternatively, the closure panel 54 can be slightly wider than the top panel 18 (see FIG. 17) to insure completely covering the second end 14, including the edges 138, 139.

Figure 18:
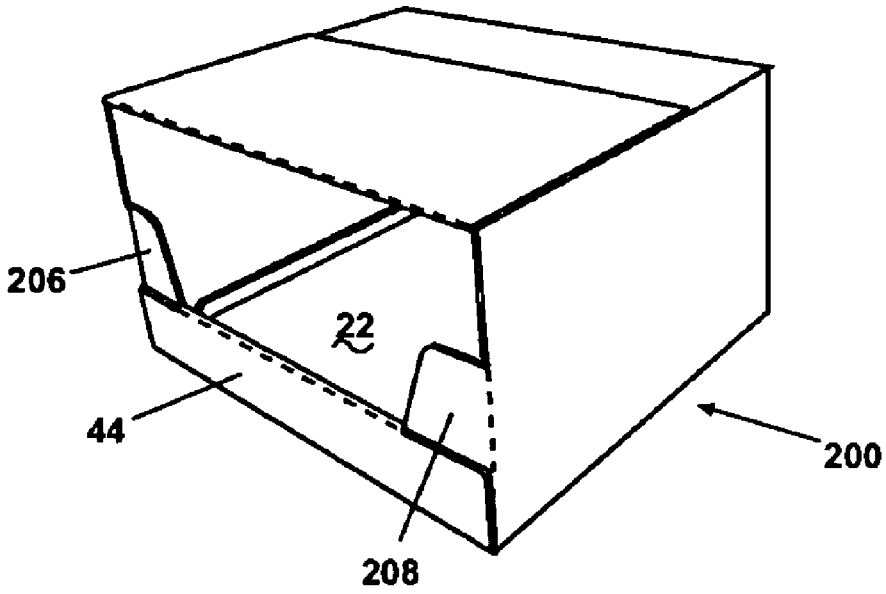
FIG. 18 is a front perspective view of a fifth embodiment of a container according to the invention with a closure panel in an open position.
Figure 19:
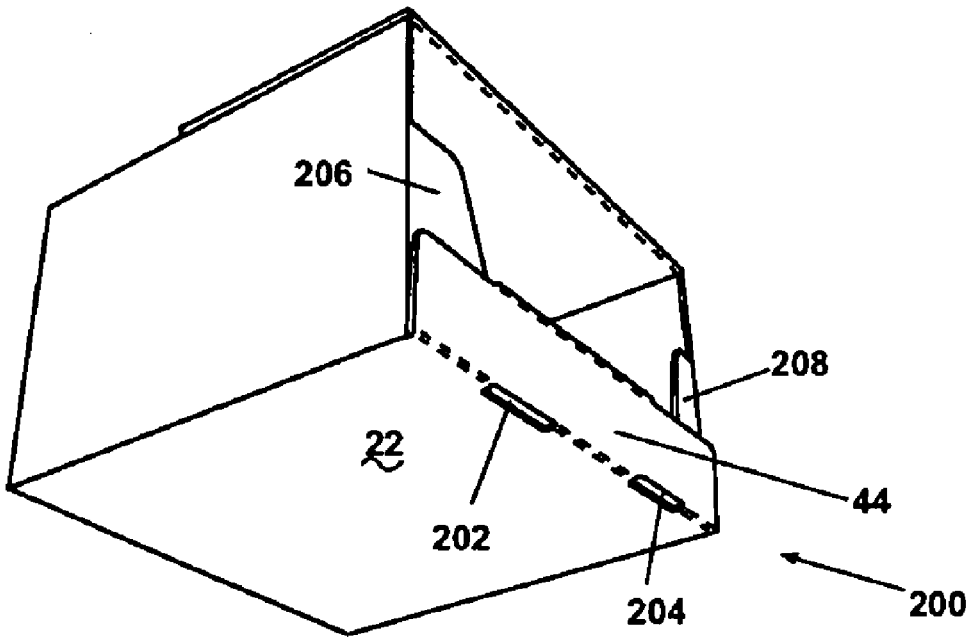
FIG. 19 is a second front perspective view of the container of FIG. 18.

A fifth embodiment of a container according to the invention is shown in the carton 200 of FIGS. 18 and 19. A principal characteristic of the carton 200 is a larger width. In order to accommodate a wider construction, yet maintain adequate rigidity for shipping and display, the bottom panel 22 may have multiple slots. Two slots 202, 204 are shown in FIG. 19, each slot receiving a separate tab (not shown) on the securing panel 44. Likewise, the slots 202, 204 can receive tabs (not shown) on the side panels 206, 208 to provide additional rigidity to the structure.

A sixth embodiment of a container according to the invention is shown in the carton 230 of FIGS. 20-24. As with the earlier embodiments of cartons, the overall construction of the carton 230 is very similar. Where components of earlier embodiment cartons appear also in the carton 230 but differ only in dimension, they will be identified by like numerals in all embodiments. The principal difference between the carton 230 and the other embodiments of cartons, other than dimension, relates to the display panel 232.

Figure 20:
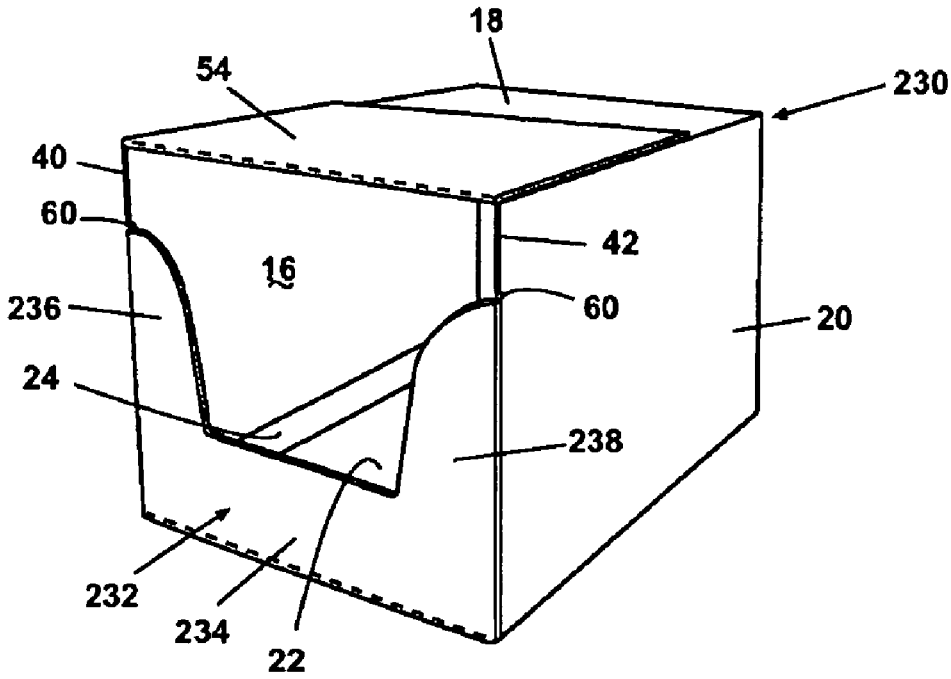
FIG. 20 is a front perspective view of a sixth embodiment of a container according to the invention with a closure panel in the open position.
Figure 21:
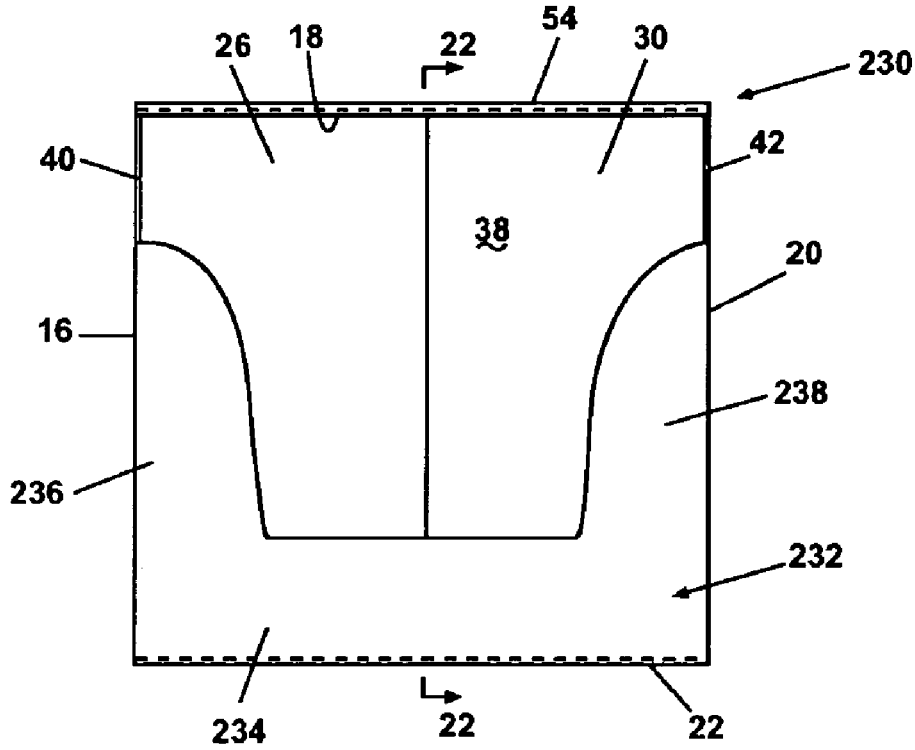
FIG. 21 is a front view of the container of FIG. 20.
Figure 22:
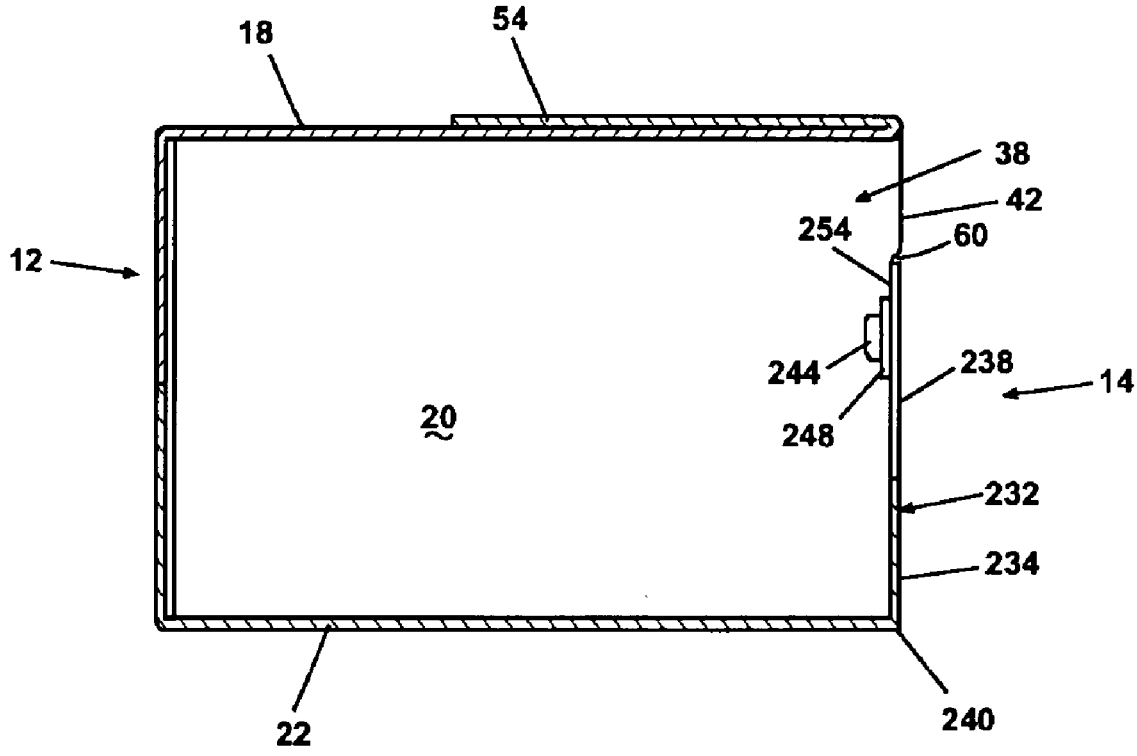
FIG. 22 is a cross-sectional view taken along line 22-22 of FIG. 21.

Looking first at FIGS. 20-22, it can be seen that the display panel 232 comprises a base portion 234 and two spaced wing portions 236, 238 that frame the opening 38 and provide a place for visible information to be added. The display panel 232 extends from the bottom panel 22 and is folded upwardly along a fold line 240. Because the display panel 232 is typically die cut, it will have clean, well-defined edges, unlike a perforated carton or a manually cut case. It can be secured to the side panels 16, 20 by tape or the like.

Figure 23:
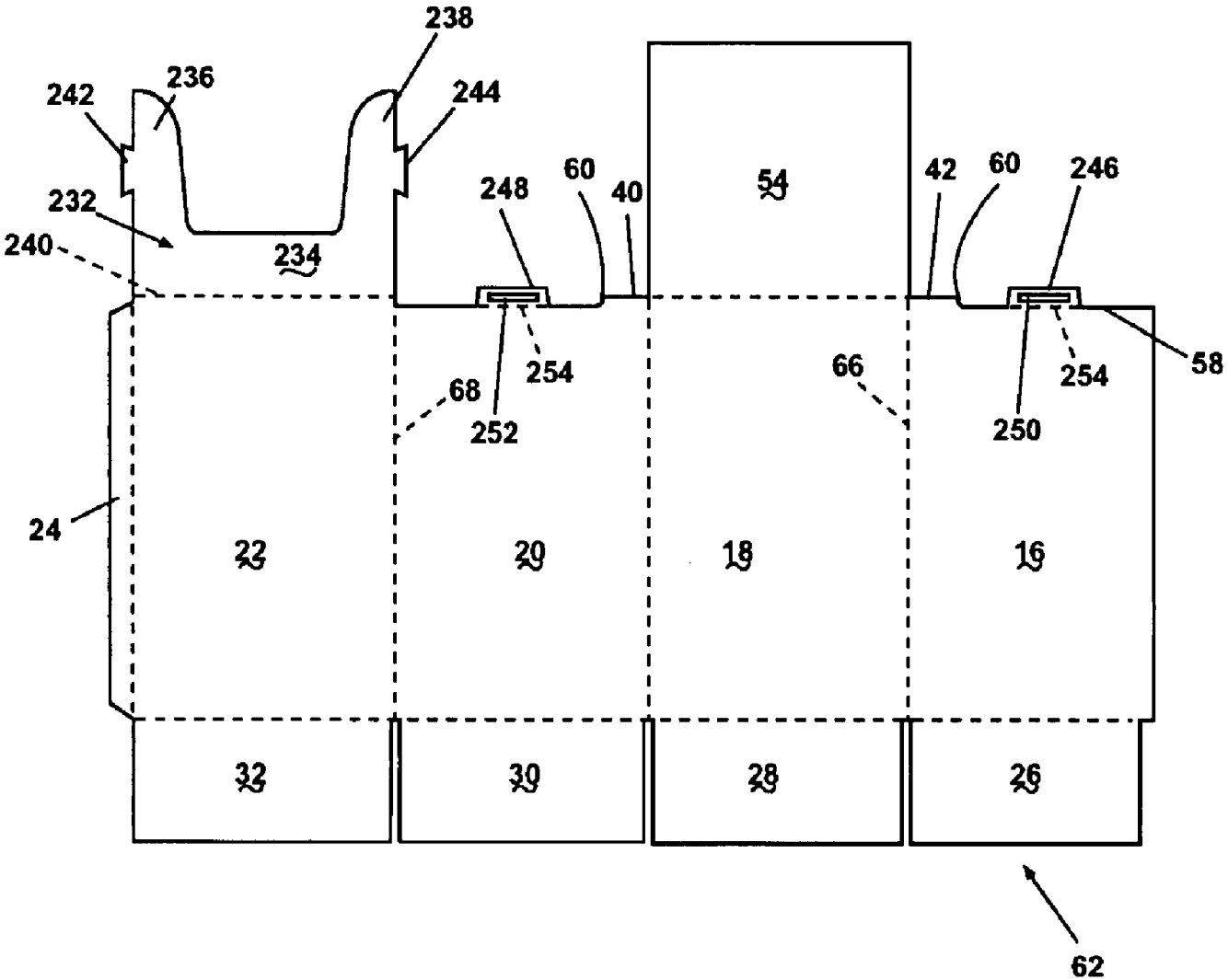
FIG. 23 is a plan view of a blank for the container of FIG. 20.
Figure 24:
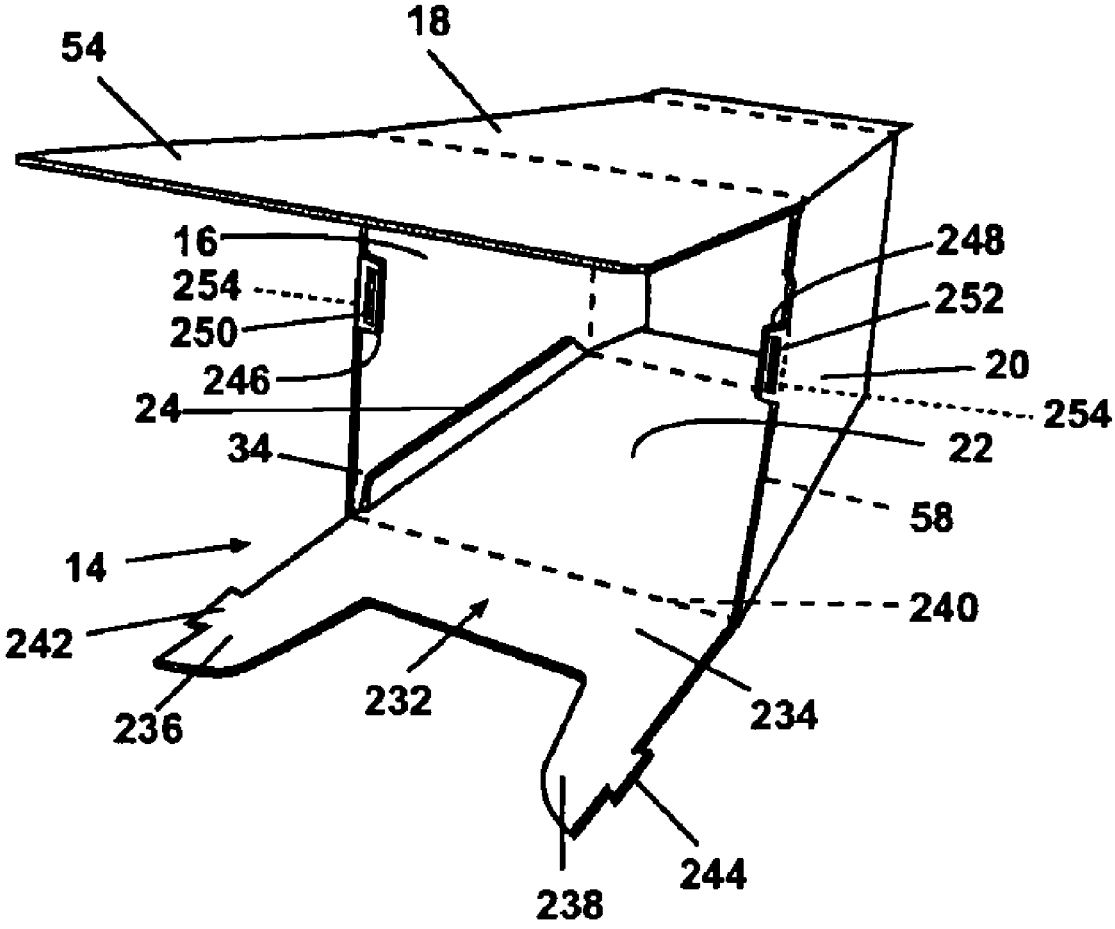
FIG. 24 is a perspective view of the blank of FIG. 23 partly erected.

Preferably, the display panel 232 is secured to the side panels 16, 22 by tabs as shown in FIGS. 23 and 24. Extending outwardly from the respective outer edges of the wing portions 236, 238 are tabs 242, 244. There may be more than one tab per edge, depending upon the dimensions of the carton 230 and the display panel 232. The tabs must be adequate to secure the display panel 232 to the side panels 16, 22 to hold the contents inside the carton while displayed. Tab flaps 246, 248 extend from the side panels 16, 20, respectively, and each has its own slot 250, 252. In erecting the carton 230 as shown in FIG. 24, the tab flaps 246, 248 are folded inwardly along fold lines 254. Display panel 232 is folded upwardly along fold line 240 and tabs 242, 244 are inserted into respective slots 250, 252.

The particular shape of the display panel 232 can be varied as desired. Wing portions 236, 238 need not exist at all. On the other hand, the display panel 232 may also include a top portion (not shown) that joins the wings so that it complete defines the opening 38. The display panel 232 need not extend from the bottom panel 22. It can extend from any panel (e.g., a side panel), other than the panel from which the closure panel 54 extends. Likewise the closure panel 54 need not extend from the top panel 18; it can extend from any panel other than the panel from which the display panel extends (in this or any other embodiment).

While the invention has been specifically described in connection with certain specific embodiments thereof, it is to be understood that this is by way of illustration and not of limitation, and the scope of the appended claims should be construed as broadly as the prior art will permit.

The invention claimed is:

1. A container for shipping and displaying contents in the container, the container comprising:

a first end having at least one panel selectively movable to close the first end, and a second end having a display panel adapted to bear indicia about contents of the container, the display panel partially defining an opening in the second end, the second end further having a closure panel selectively movable between a closed position where it covers the opening and the display panel, and an open position wherein the opening and the display panel are exposed;

whereby contents of the container can be shipped when the at least one panel securely closes the first end and the closure panel is secured in the closed position, and contents of the container and any indicia on the display panel can be viewed only by moving the closure panel to the open position.

2. A container according to claim 1 further comprising top, bottom and side panels extending between the first and second ends, wherein the display panel extends from a hinge on one of the top, bottom and side panels, and the closure panel extends from a hinge on another of the top, bottom and side panels.

3. A container according to claim 2 wherein the closure panel is secured away from the hinge to one of the top, bottom and side panels in the open position.

4. A container according to claim 3 wherein the closure panel has a tab and the one panel has a slot and the closure panel is secured to the one panel when the tab is received in the slot.

5. A container according to the claim 1 wherein the display panel comprises two side panels and a securing panel wherein the securing panel interlocks with the side panels.

6. A container according to claim 5 wherein the securing panel has a cover portion and a flap portion, and the flap portion engages a slot in an adjacent panel.

7. A container according to claim 6 wherein the flap portion has a tab that engages the slot.

8. A container according to claim 6 wherein at least one side panel has a tab that engages the slot.

9. A container according to claim 5 wherein the side panels have sloped edges.

10. A container according to claim 5 wherein the side panels are covered by the securing panel.

11. A container according to claim 1 wherein the first end comprises full overlap panels.

12. A container according to claim 1 wherein the display panel comprises a bottom portion and two side portions.

13. A blank for forming a container for shipping and displaying contents in the container, the blank comprising:

four panels connected together in series at fold lines, a first panel at one side of the series having a side flap for mounting to a second panel at the opposite side of the series, and the four panels having first ends and second ends, the first ends of the four panels collectively defining a first end of the erected container, and the second ends of the four panels collectively defining a second end of the erected container, the first end of each panel having an end panel extending therefrom, the second end of one of the four panels having a closure panel extending therefrom at a fold line and sized to cover the second end of the erected container, the closure panel having means to secure it away from the fold line to one of the four panels, the second end of the four panels, other than the one having a closure panel extending therefrom, having a display panel extending therefrom.

14. A blank according to claim 13 wherein the display panel comprises each of two of the four panels, one on either side of the one panel when the container is erected, having a side panel extending from an edge thereof, the side panels being located away from where the closure panel extends from the one panel when the container is erected, and the second end of the fourth of the four panels having a securing panel extending therefrom with a slot near where the securing panel extends from the fourth panel, the securing panel having a cover portion and a flap extending from the cover portion, adapted to engage the slot and long enough to reach the slot when folded against the cover portion over the side flaps.

15. A blank according to claim 14 wherein the flap has a tab adapted to reach and engage the slot.

16. A blank according to claim 14 wherein the edges of the two of the four panels are offset so that the closure panel can be flush with the second end when it is in the closed position.

17. A blank according to claim 14 further comprising a tab on the closure panel and securing slot on the one of the four panels to secure the closure panel to the one panel.

18. A blank according to claim 14 wherein at least one of the side panels has a tab to engage the slot.

19. A flat preform formed from a blank according to claim 13, wherein the first panel side flap is mounted to the second panel and the side panels are folded at the only two of the fold lines.

20. A container for shipping and displaying contents therein comprising:

a first end having at least one panel selectively movable to close the first end, and a second end having a display panel that partially defines an opening in the second end, the second end further having a closure panel selectively movable between a closed position where it covers the second end including the opening and the display panel, securing the contents of the container for shipping, and an open position wherein the opening and the display panel are exposed;

all panels being corrugated;

whereby contents of the container can be independently shipped when the at least one panel closes the first end and the closure panel closes the second end, and contents of the container and the display panel can be viewed by moving only the closure panel to the open position.

21. A container according to claim 1 wherein the panels are formed of corrugated paper.

22. A container according to claim 1 wherein the display panel defines more than one side of the opening.

23. A container according to claim 22 wherein the display panel is L-shaped.

24. A container according to claim 1 wherein the display panel is a single panel that extends between adjacent side panels.

25. A container according to claim 24 wherein the display panel is U-shaped.

26. A container according to claim 20 wherein the display panel defines more than one side of the opening.

27. A container according to claim 26 wherein the display panel is L-shaped.

28. A container according to claim 20 wherein the display panel is a single panel that extends between adjacent side panels.

29. A container according to claim 28 wherein the display panel is U-shaped.

30. A container according to claim 1 wherein the display panel bears indicia about the contents of the container.

31. A container according to claim 22 wherein the display panel bears indicia about the contents of the container.

* * * * *